United States Patent [19]

Imamura

[11] 4,202,307

[45] May 13, 1980

[54] IGNITION PLUG

[76] Inventor: Yoshio Imamura, 12-8 Higashi-Cho, Fujinomiya-Shi, Shizuoka-Ken, Japan

[21] Appl. No.: 957,157

[22] Filed: Nov. 2, 1978

[30] Foreign Application Priority Data

Nov. 5, 1977 [JP] Japan ..... 52-132753

[51] Int. Cl.[2] ..... F02P 23/00

[52] U.S. Cl. ..... 123/169 V; 123/151

[58] Field of Search ..... 123/169 V, 151

[56] References Cited

U.S. PATENT DOCUMENTS

| | | | |
|---|---|---|---|
| 1,241,199 | 9/1917 | Crompton | 123/151 |
| 1,393,174 | 10/1921 | Shepard | 123/151 |
| 1,401,612 | 12/1921 | Landgrebe | 123/151 |
| 1,466,943 | 9/1923 | Ball et al. | 123/151 |
| 3,648,669 | 3/1972 | Rank | 123/169 V |
| 3,710,764 | 1/1973 | Jozlin | 123/169 V |
| 4,061,113 | 12/1977 | Beyler | 123/169 V |
| 4,079,721 | 3/1978 | Brown | 123/169 V |

*Primary Examiner*—Charles J. Myhre
*Assistant Examiner*—R. A. Nelli
*Attorney, Agent, or Firm*—Pearne, Gordon, Sessions, McCoy & Granger

[57] ABSTRACT

An ignition plug for an internal combustion engine which comprises a hollow cylindrical main body having one externally threaded end portion and the other end portion in the form of a nut, said threaded end portion being provided with jet orifices, air guide grooves and a communication groove; a tubular anode member having an insulation body and extending through said main body; a center electrode extending through said insulation body; and a check valve assembly mounted about the intermediate portion between the two end portions of the main body, said valve assembly comprising a ring-shaped valve housing having a tapered seat face and air intake bores and a ring-shaped valve body reciprocally received in said valve housing and having a matingly tapered outer surface for opening and closing said air intake bores in the valve housing.

5 Claims, 2 Drawing Figures

IGNITION PLUG

BACKGROUND OF THE INVENTION

This invention relates to an improved ignition plug for an internal combustion engine such as a gasoline engine and more particularly, to such an ignition plug which is capable of effectively discharging residual gas which often remains in the engine cylinder after one cycle operation of the engine before the engine is fired for the next cycle operation.

Such residual gas in the cylinder of the internal combustion engine generally tends to reduce the average effective pressure and charging efficiency of the engine and substantially increase the temperature of the cylinder of the engine and thus, the temperature and weight of the residual gas has a great effect on the performance of the engine.

Especially, it has been found that the pressure of a portion of the combustion gas within the engine cylinder is reduced to a value lower than atmospheric pressure on the air-intake, explosion and scavenging strokes in one cycle operation of the engine. Such pressure drop phenomenon occurs in various types of engines such as gasoline engines, Diesel engines and rotary engines and the cause of the gas pressure drop is considered as the result of the reduction in pressure of the burnt combustion gas at the time of propagation of flames.

In order to overcome the difficulties, various attempts have been made by blowing secondary air into the engine cylinder so as to reduce the weight and temperature of the residual gas in the engine cylinder. As one of these attempts, the applicant has developed an ignition plug which concurrently has the function as a check valve. The ignition plug generally comprises a hollow anode member having a center through opening, a center electrode extending through the center opening in co-axial therewith and having an air intake passage which communicates the interior of the engine cylinder with atmosphere and a check valve provided in the air intake passage for the prevention of reverse flow of the gas within the cylinder.

The ignition plug is easily adaptable to the above-mentioned secondary air introduction method without substantially modifying the principal components of the engine in which the ignition plug is incorporated and has been expected that the ignition plug would operate effectively.

However, in the ignition plug referred to hereinabove, since the center electrode having a very small diameter is provided with the air intake passage and check valve, the ignition plug is not expected to have sufficient mechanical strength and service life. And since the construction of the ignition plug is such that a valve chamber having a tapered seat face is formed on the inner surface of the air intake passage in the center electrode and a spherical valve member is received in the valve chamber and normally urged against the tapered seat face by means of a compressed spring, the ignition plug can not provide a satisfactory air-tight seal. In addition, the check valve frequently fails to open and close in proper timing relationship to the strokes in one cycle operation of the engine and instead the gaseous mixture flows in the reverse direction within the cylinder to cause an abnormal explosion in the cylinder resulting in premature wear of the check valve. Thus, the ignition plug of the above-mentioned type can not be utilized to full advantage inherent in the external air introduction method and does not provide its expected effects. Such being the situation, the ignition plug has not been practically employed.

SUMMARY OF THE INVENTION

Therefore, one object of the present invention is to provide an improved ignition plug for an internal combustion engine which can effectively eliminate the disadvantages inherent in the prior art ignition plugs.

Another object of the present invention is to provide an improved ignition plug which provides satisfactory air-tight seal, is simple in construction and compact and enjoys a long service life.

Another object of the present invention is to provide an improved and practical ignition plug which effectively introduces external air into the cylinder of an internal combustion engine properly timed to the strokes in one cycle operation of the engine.

When the improved ignition plug of the invention is incorporated into an internal combustion engine or the like, the volumetric efficiency, charging efficiency and effective pressure of the engine can be substantially improved to thereby attain saving in fuel and reduce the amount of nitrogen exide to be produced.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the same in any way.

PREFERRED EMBODIMENT OF THE INVENTION

Figure 1:
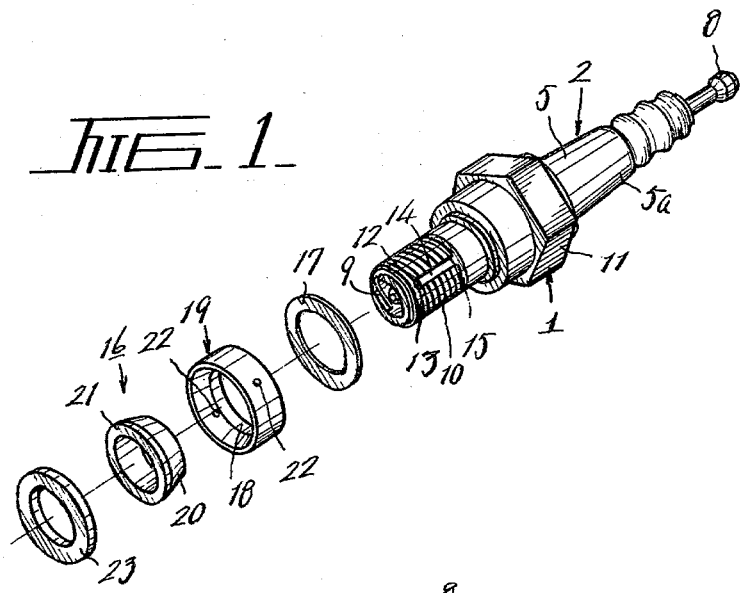
FIG. 1 is an exploded perspective view of the ignition plug embodying the present invention.

The present invention will be now described referring to the accompanying drawing in which one preferred embodiment of the ignition plug of the invention is illustrated.

The ignition plug generally comprises a hollow cylindrical main body generally shown by reference numeral 1 and adapted to be mounted in the cylinder head CH of an internal combustion engine (not shown) and a tubular anode member generally shown by reference numeral 2 and extending vertically through the stepped opening defined by the main body 1. The stepped opening includes an upper larger diameter portion 1*a* and a lower smaller diameter portion 1*b* connected together by a downwardly sloped shoulder 1*c*.

The anode member 2 has substantially the same construction as the corresponding parts of the prior art engine ignition plugs and generally comprises an elongated hollow insulation body 5 formed of sintered porcelain and including an upper end portion 5*a* extending beyond the upper end of the main body 1, an intermediate enlarged diameter portion 5*b* having the outer diameter substantially the same as the diameter of the larger diameter portion 1*a* of the stepped opening in the main body 1 and a lower reduced diameter end portion 5*c* tapering downwardly and terminating at the lower end face of the main body 1. The upper and intermediate portions 5a, 5b are connected together by an upper sloped shoulder 5d and the intermediate and lower portion 5b, 5c are connected together by a lower sloped shoulder 5e. The hollow anode member 2 is received in the main body 1 in air-tight relationship to the latter by means of cotton packing material 3 interposed between the shoulders 1c, 5e and filler powder 4 interposed between the upper portion 5a and shoulder 5d of the insulation body 5 and the larger diameter portion 1a of the tapered opening in the main body 1. The anode member 2 further includes a center electrode 6 extending through the vertical center bore in the insulation body 5. One or the lower end of the center electrode 6 extends beyond the lower end of the insulation body 5 and the other or upper end of the center electrode also extends beyond the upper end of the insulation body 5 and has a terminal member 8 secured thereto by means of a set screw (not shown) to thereby firmly secure the center electrode 6 to the insulation body 5.

An electrode 9 is integrally formed with and extends laterally from the lower end face of the main body 1 across the main body in spaced relationship to the lower end face of the center electrode 6. The lower end portion of the main body 1 is reduced in diameter and externally threaded at 10 for threadable engagement with a mating threaded opening 24 in the cylinder head CH. The upper end portion 11 of the main body 1 is bulged outwardly and has a hexagonal outer surface to form a nut portion for receiving a conventional fastening means such as a wrench thereon.

The reduced diameter threaded lower end portion of the main body 1 is provided with a pair of diametrically opposite jet orifices 12, 12 extending at right angles to the axis of the main body and in communication with the hollow interior or opening of the main body 1 and with a co-axial lower annular communication groove 13 in communication with the jet orifices. Also provided on the threaded lower end portion of the main body are a pair of diametrically opposite air intake grooves 14, 14 extending in parallel to the axis of the main body and in communication at the lower ends with the annular communication groove 13.

The intermediate portion between the threaded lower end portion 10 and nut-shaped apper end portion 11 of the main body 1 has a co-axial upper annular communication groove 15 formed in a position right above the upper ends of the air intake grooves 14, 14 in communication with the grooves. A ring-shaped check valve assembly 16 is mounted about the main body intermediate portion surrounding the upper annular communication groove 15 and an annular plate packing 17 is also mounted about the main body intermediate portion in a position right above the check valve assembly 16 to retain the check valve assembly in position.

As more clearly shown in FIG. 1, the check valve assembly 16 comprises a valve housing 19 in the form of a ring having a downwardly flared inner seat face 18 and a valve body 21 slidably and reciprocally received in the valve housing and having a mating downwardly flared outer surface 20 for engagement with the flared inner seat face 18 on the valve housing 19.

The valve housing 19 is provided with a pair of diametrically opposite air intake bores 22, 22 for communicating between the upper communication groove 15 and external air and an annular seal 23 is mounted about the upper edge of the threaded lower end portion 10 of the main body 1 in a position right below the upper annular communication groove 15 to maintain the opening in the valve housing 19 and the upper annular communication groove 15 air-tight. The annular seal 23 is formed of copper or the like material and concurrently serves as a packing.

The valve housing 19 and valve body 21 are made of materials having different hardnesses. In the illustrated embodiment, the valve housing 19 is formed of a metal having a higher hardness and the valve body 21 is formed of a material having a lower hardness such as brass. In such a case, when the valve body 21 moves reciprocally and slidably within the valve housing 19 during one cycle operation of the engine (not shown), the flared outer surface 20 of the valve body 21 deforms gradually as the valve body outer surface cyclically strikes against the flared seat face 18 of the valve housing 19 whereby the valve body outer surface provides a self-compensation function to improve air-tightness at the interface between the valve housing and valve body.

Figure 2:
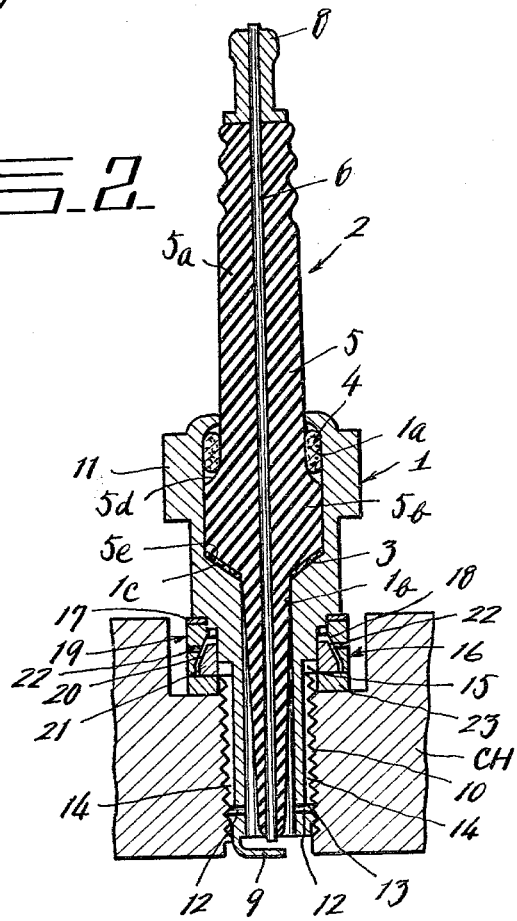
FIG. 2 is a vertically sectional view of said ignition plug as being mounted in an engine cylinder head.

When the ignition plug having the construction and arrangement of its components as referred to hereinabove is mounted in the cylinder head CH as shown in FIG. 2, the lower annular communication groove 13 and air intake grooves 14, 14 of the main body threaded lower end portion 10 are air-tightly sealed by the fact that the threaded lower end portion 10 is in threaded engagement with the inner threaded opening 24 of the cylinder head CH. Thus, the interior of the engine cylinder is communicated with atmosphere through the jet orifices 12, 12, lower communication groove 13, air intake grooves 14, 14 and upper communication groove 15 of the main body 1 and the air intake bores 22, 22 of the valve housing 19.

The operation of the gasoline engine having the ignition plug incorporated therein will be now described. On the blowdown air intake strokes, the interior of the engine cylinder is maintained at a pressure somewhat lower than atmospheric pressure by the air intake inertia or the like and thus, the check valve assembly 16 is in its opened position to admit external air into the cylinder as secondary air whereby the residual gas within the cylinder is expelled out of the cylinder through the exhaust port (not shown). The thus admitted secondary air can be fully employed as the combustion support air on the succeeding compression and explosion strokes to thereby substantially improve the volumetric efficiency, charging efficiency and pressure efficiency of the engine and also prevent overheating of the ignition plug.

And on the explosion stroke, the valve body 21 of the check valve assembly 16 is closed under the pressure within the cylinder and opened on the succeeding blowdown and air intake strokes. In this way, each time the engine performs its operation cycle, the check valve is opened and closed to admit secondary air into the cylinder and prevent inflow of the air to the cylinder.

Although the valve housing of the check valve assembly is held in position about the main body by means of an O-ring (not shown) in the illustrated embodiment, the present invention is not limited to such arrangement and the valve housing may be directly secured to the periphery of the main body without departing from the scope of the present invention.

As described hereinabove, according to the present invention, since the plug main body is provided with the jet orifices and annular air intake grooves in communication with the jet orifices and the ring-shaped check valve assembly is mounted about the main body, the entire ignition plug is simpler in construction and assembling than the prior art ignition plugs and the mechanical strength and durability of the ignition plug of the invention are substantially higher than those of the prior art ignition plugs.

Furthermore, according to the present invention, since the valve housing and valve body engage in face-to-face contact to thereby improve air-tightness therebetween and the valve body merely moves reciprocally and slidably within the valve housing under differential pressure between the explosion and exhaust strokes, the valve body positively opens and closes the check valve in precise response to the strokes in one cycle operation of the engine to thereby effectively admit external air into the engine cylinder.

Thus, the check valve in the ignition plug of the invention eliminates the possibility of abnormal explosion due to leakage at the seals and ensures a long service life.

Experiments have found that when the ignition plug having the check valve assembly of the invention is incorporated in a vehicle engine of 2,000 cc displacement, the running distance of the vehicle per unit of fuel consumption is 12 km/l as compared with the running distance of 7 km/l of the same vehicle not having the igniton plug of the invention incorporated therein to thereby attain substantial saving in fuel consumption and therefore, the present invention provides a quite practical ignition plug.

While only one embodiment of the invention has been shown and described in detail, it will be understood that the same is for illustration purpose only and not to be taken as a definition of the invention, reference being had for the purpose to the appended claims.

What is claimed is:

1. An ignition plug for an internal combustion engine comprising a hollow cylindrical main body adapted to be mounted in the cylinder head of said engine and having jet orifices in communication with the hollow interior of said main body and air intake means in communication with said jet orifices; a tubular anode member including an insulation body extending through said main body and having a vertical through-opening and a center electrode extending through said vertical through-opening in the insulation body; and a check-valve assembly mounted about said main body and including a ring-shaped valve housing having a tapered valve seat on the inner surface, a ring-shaped valve body reciprocally received in said valve housing and having a matingly tapered outer surface and an annular seal for sealing said valve housing to said main body.

2. The ignition plug as set forth in claim 1, in which said main body includes one reduced diameter threaded end portion in threaded engagement with a mating threaded opening in said cylinder head, the other enlarged diameter end portion in the form of a nut and the intermediate portion positioned between said two end portions and about which said check valve assembly is mounted.

3. The ignition plug as set forth in claim 2, in which said jet orifices are formed in said reduced diameter end portion and extending at right angles to the axis of said main body and said air intake means comprises a first annular air intake groove co-axially formed on said threaded end portion in communication with said jet orifices, vertical communication grooves formed on said threaded end portion in communication at one end with said first annular air intake groove and a second annular air intake groove formed on said intermediate portion in communication with the other ends of said vertical communication grooves.

4. The ignition plug as set forth in claim 1, in which said hollow interior of the main body defines a stepped opening including a larger diameter portion and a smaller diameter portion connected together by an intermediate shoulder and said insulation body has an enlarged diameter portion seating on said shoulder with cotton packing material interposed between one face of said enlarged diameter portion of the insulation body and the shoulder and filler powder is interposed between the other face of said enlarged diameter portion of the insulation body and said larger diameter portion of the stepped opening.

5. The ignition plug as set forth in claim 1, in which said main body includes an electrode integrally formed with and laterally extending from the distal end of said threaded end portion of the main body in spaced relationship to the adjacent end face of said center electrode.

* * * * *